United States Patent [19]

Miller et al.

[11] Patent Number: 4,609,909

[45] Date of Patent: Sep. 2, 1986

[54] MULTIMODE PERIMETER INTRUSION DETECTION SYSTEM

[75] Inventors: G. Kirby Miller; Melvin E. Trimble; Mark R. Magee, all of Saratoga, Calif.

[73] Assignee: GTE Government Systems Corporation, Stamford, Conn.

[21] Appl. No.: 707,786

[22] Filed: Mar. 4, 1985

[51] Int. Cl.[4] ..... G08B 13/00; G08B 13/18

[52] U.S. Cl. ..... 340/541; 340/521; 340/554; 340/564; 340/566; 367/94

[58] Field of Search ..... 340/541, 554, 552, 565, 340/566, 564, 521, 522, 550, 551; 367/93, 94

[56] References Cited

U.S. PATENT DOCUMENTS

| | | | |
|---|---|---|---|
| 3,573,817 | 4/1971 | Akers | 340/566 |
| 3,763,482 | 10/1973 | Burney et al. | 340/564 |
| 3,833,897 | 9/1974 | Bell et al. | 367/136 |
| 3,846,778 | 11/1974 | Galvin et al. | 340/522 |
| 3,947,835 | 3/1976 | Laxmon | 340/566 |
| 4,023,155 | 5/1977 | Miller | 367/93 |
| 4,097,025 | 6/1978 | Dettmann et al. | 340/566 |
| 4,368,460 | 1/1983 | Clinard et al. | 340/522 |

*Primary Examiner*—Donnie L. Crosland
*Attorney, Agent, or Firm*—Douglas M. Gilbert; John F. Lawler

[57] ABSTRACT

A multimode perimeter intrusion detection system comprises at least one elongated electret tape mounted on a barrier, such as a fence or wall, along the perimeter of an area to be protected and operated simultaneously in both active and passive modes to detect intruders in proximity to, as well as in contact with, the barrier. The tape is directly mechanically coupled to the barrier above and parallel to the ground or floor and is electrically connected to a sound wave generator and to signal processing apparatus which detects signals produced on the tape by intruders and activates an alarm. In the active mode, the tape radiates sound waves, preferably in the ultrasonic range, outwardly from the barrier and receives doppler-shifted reflections from a person moving in the sound field for transmission to the signal processing apparatus. In the passive mode, the tape senses vibrations in the barrier caused by contact with the intruder, converts the vibrations to signals and transmits the latter to the signal processing apparatus. In a second passive mode, the tape also acts simultaneously as a line microphone to pick up audio sounds and to transmit them to a loudspeaker at the monitoring station. In a preferred form of the invention two of such tapes are mounted in juxtaposition and coextensively on the barrier, one tape functioning as the ultrasonic wave radiator, the other tape being the receiver-connected transducer.

8 Claims, 7 Drawing Figures

FIG. 5
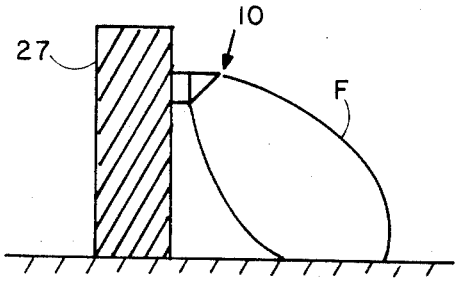
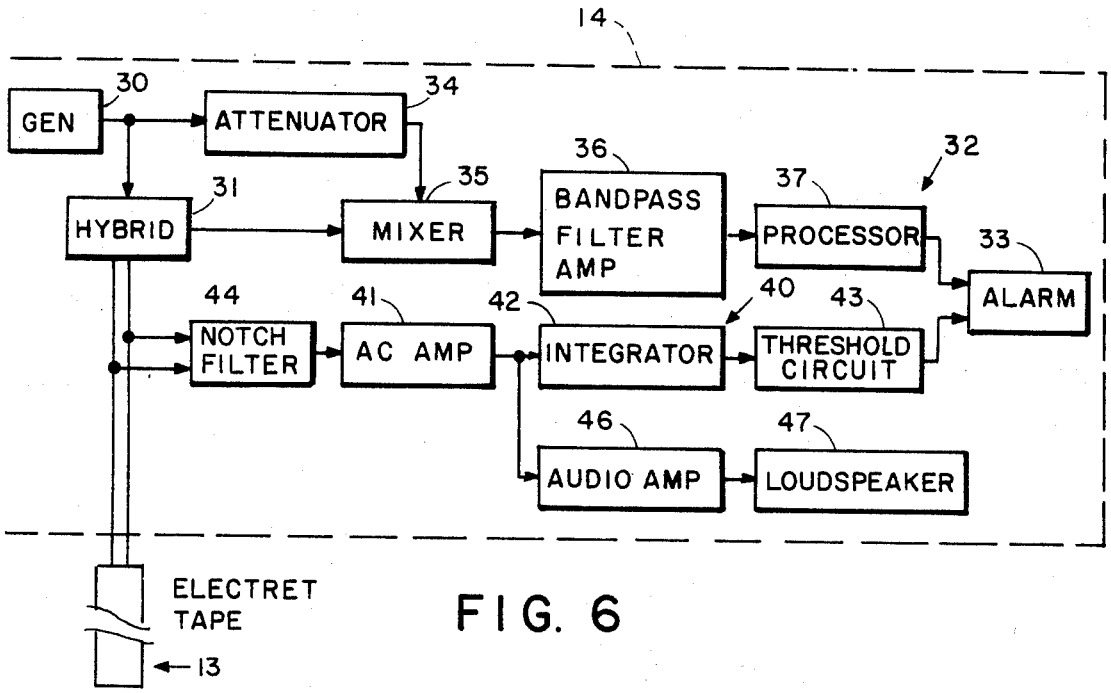
FIG. 6
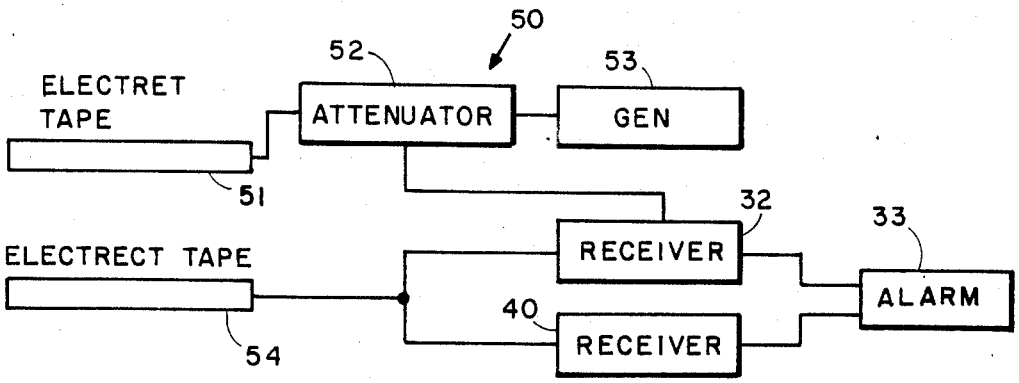
FIG. 7

MULTIMODE PERIMETER INTRUSION DETECTION SYSTEM

This invention was made under a contract with the Defense Nuclear Agency.

BACKGROUND OF THE INVENTION

This invention relates to intrusion detection systems and more particularly to a multimode perimeter intrusion detection system.

A current perimeter intrusion detection system capable of reliably detecting intrusions that involve mechanical excitation of a fence is described in U.S. Pat. No. 3,763,482. This system, however, cannot detect an intruder who crosses the fence without touching it, for example, by climbing an adjacent ladder and jumping over the fence. One way to overcome this limitation is to use a second intrusion detection system, such as one having an infrared beam directed along one or both sides of the fence and which activates an alarm when the beam is interrupted. While this technique is effective, it is substantially more costly than a single fence-mounted system and is more time consuming to install and maintain.

Another perimeter intrusion detection system described in U.S. Pat. No. 4,023,155 comprises a continuous electret tape on the wall of a room or on the ground and capable of radiating ultrasonic waves outwardly from the tape. A person moving through the radiation zone reflects a doppler-shifted signal which is detected and activates an alarm. This system is effective for the single purpose of volumetric intrusion detection and heretofore has been limited to this type of protection.

The general problem experienced with single mode intrusion detection systems is limited protection capability and/or limited reliability. As mentioned above, the fence-mounted cable sensor described in U.S. Pat. No. 3,763,482 only detects vibrations transmitted to it through the fence or otherwise; an intruder who vaults over the fence is home free. While this cable sensor also acts as a line microphone to pick up sonic vibrations incident on it as described in U.S. Pat. No. 3,833,897, a quiet vaulting intruder may still defeat the system. Sonic or ultrasonic volumetric systems provide a physically broader or "blanket" type protection zone but are vulnerable to non-intruder type disturbances such as wind, temperature changes, falling branches or leaves, etc. in generating false alarms, thus making them less reliable. The above limitations of single mode systems can be reduced or minimized by redundancy, that is providing two or more separate and different systems but this approach is costly.

This invention is directed to a solution to these problems.

OBJECTS AND SUMMARY OF THE INVENTION

A general object of the invention is the provision of a single security system capable of operating in two different detection modes simultaneously.

A further object is the provision of a multimode detection system which has substantially increased microphonic sensitivity.

A more specific object is the provision of a perimeter intrusion detection system which operates simultaneously in an active mode and in a passive mode.

These and other objects of the invention are achieved with an elongated electret tape mechanically coupled to a perimeter barrier and electrically connected to an ultrasonic wave generator and to circuits which simultaneously detect doppler-shifted reflections and vibrations incident on the tape through the barrier or through the air.

DESCRIPTION OF THE DRAWINGS

FIG. 5 is a view similar to FIG. 4 showing the tape mounted on wall.

FIG. 6 is a simplified schematic block diagram showing the circuits used in practicing the invention.

FIG. 7 is a block diagram of a dual tape form of the invention.

DESCRIPTION OF PREFERRED EMBODIMENT

Figure 1:
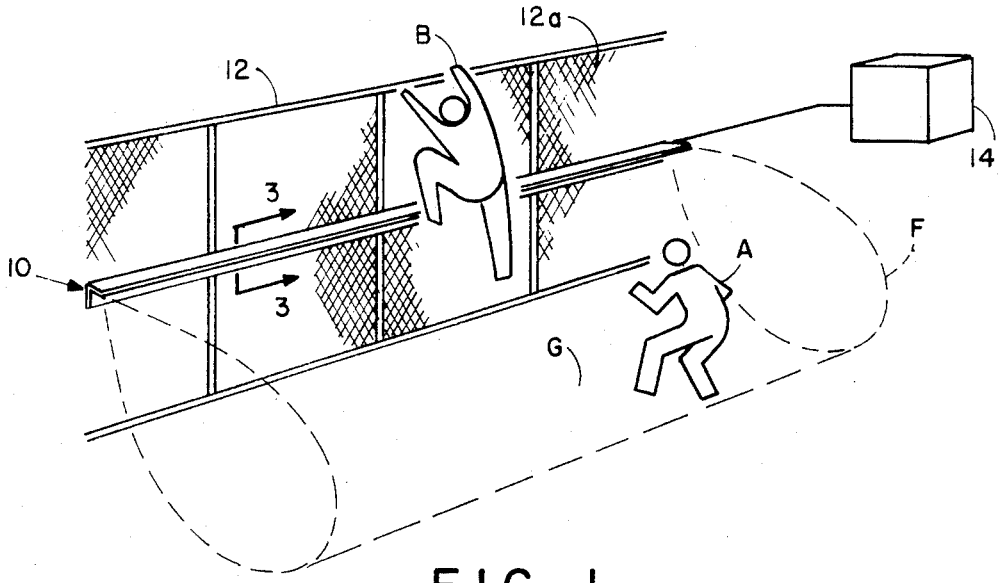
FIG. 1 is a schematic perspective view of a portion of a fence-mounted multimode detection system embodying the invention and showing a pair of intruders activating two of the system's operating modes.
Figure 4:
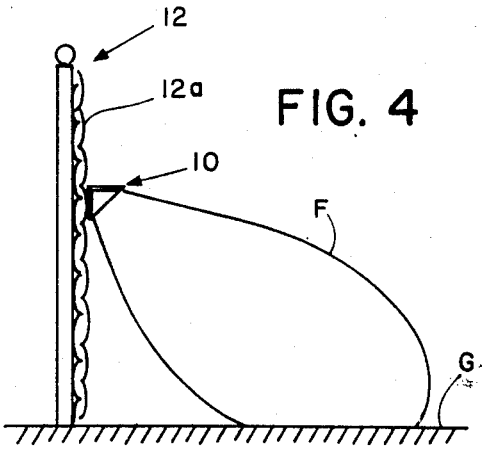
FIG. 4 is a transverse section of the fence-mounted tape energized in the active mode and illustrating the direction of the radiated acoustic field in a preferred embodiment of the invention.

Referring now to the drawings, a multimode intrusion detection system embodying the invention is shown in part in FIG. 1 as an elongated line sensor assembly 10 mounted on a barrier 12 such as a wire mesh fence anchored to the gound G along the perimeter of an area to be protected. Assembly 10 is mounted on fence 12 preferably at mid-height or higher, extends generally parallel to the ground and comprises an electret transducer in the form of a flat tape 13, see FIG. 2, electrically connected at one end to control apparatus 14. Tape 13 is energized by apparatus 14 and directs an acoustic field F outwardly and downwardly from the vertical plane of the fence, see FIG. 4, which field is intercepted by an intruder A remote from the fence to activate an alarm. Intruder B, in climbing fence 12 as shown, produces vibrations in the fence mesh 12*a* which are sensed by tape 13 to also activate an alarm. The single tape system thus operates in two different modes, one active and one passive, to make the fence more difficult to compromise and to therefore provide greater security for the area being protected.

Figure 2:
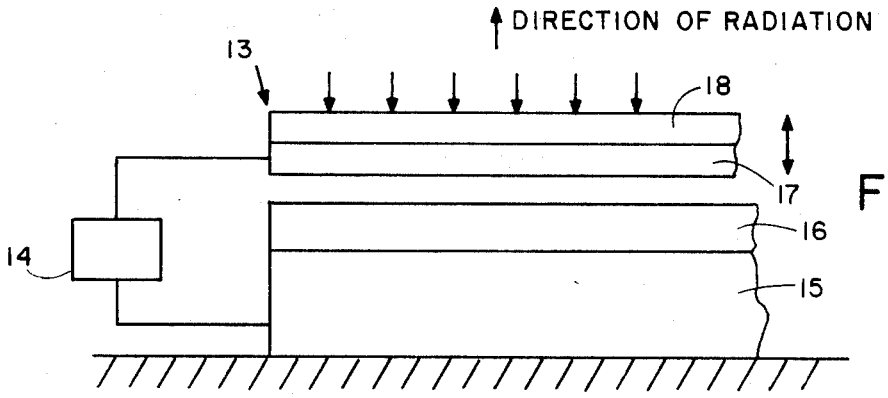
FIG. 2 is a schematic diagram of the tape transducer illustrating the principle of operation.

Tape 13 is a laminar structure having an inner conductor 15, see FIG. 2, an electret 16, such as polytetrafluorethylene (Teflon), bonded tightly to inner conductor 15, an outer conductor 17 mounted on and spaced slightly from electret 16, and a synthetic jacket or cover 18 secured to outer conductor 17. Electret 16 carries a permanent electrostatic charge. An alternating current applied by apparatus 14 at ultrasonic frequencies, for example, across conductors 15 and 17 causes movement of outer conductor 17 toward and away from electret 16 as indicated by the double headed arrow and produces the acoustic field F in a direction normal to the plane of tape 13. Conversely, ultrasonic waves incident on cover 18 as indicated by the single headed arrows produce movement of outer conductor 17 relative to electret 16 and generates an alternating current of corresponding frequency across conductors 15 and 17. These characteristics of electret tape 13 are described in U.S. Pat.

No. 4,023,155 and do not per se constitute this invention.

In accordance with this invention, it has been discovered that mechanically coupling inner conductor 15 of the tape to a vibrating mass produces an alternating signal across conductors 15 and 17. Such vibrations when coupled to the back (i.e., conductor 15) of tape 13 cause corresponding movement of electret 16 relative to outer conductor 17 and thus produce a signal on the conductors. Vibrations in a fence caused by an intruder climbing the fence are therefore detectable by tape 13 with inner conductor 15 mechanically coupled to the fence fabric, together with associated detection circuits. In addition, it has been discovered that tape 13 has a very high sensitivity, e.g., −50 dbV/Pa, to sonic waves in the voice band and produces a strong signal on conductors 15 and 17 in response such waves incident on it. In short, tape 13 is a highly sensitive line microphone.

Figure 3:
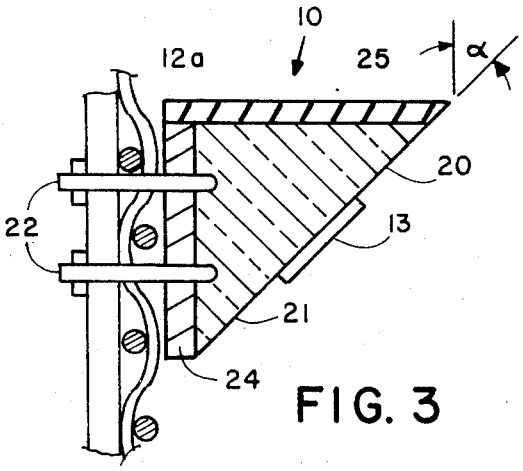
FIG. 3 is an enlarged transverse section of the tape and its support member taken on line 3—3 of FIG. 1.

In order to mount tape 13 on fence 12, line sensor assembly 10 has a solid elongated body 20, see FIG. 3, with a triangularly-sized cross-section and a flat downwardly and inwardly inclined outer surface 21 to which tape 13 is secured by cement or the like with inner conductor 15 adjacent to surface 21. The angle of incline of surface 21 with the vertical plane of the fence is selected to direct the acoustic field radiated by tape 13 sufficiently far from the fence to prevent vaulting over it while blocking attempts to crawl under it. A satisfactory value for angle is 45° depending on the mounting height. Body 20 preferably is composed of a plastic material which is somewhat flexible while being sufficiently hard to readily transmit vibrations to tape 13. Clamps 22 secure body 20 to the fabric **12*a* of the fence at longitudinally spaced intervals. In order to facilitate installation of tape 13 on the fence, an elongated semi-hard plastic clamp-mounting strip 24 is cemented or otherwise secured to the backside of body 20 after clamps 20 have been assembled with body 20. An acoustic insulator 25 made of plastic foam or the like is added to the top of body 20** to minimize or eliminate the noise effects of raindrops impact on the assembly.

Line sensor assembly 10 may also be installed with the utility and advantage mentioned above on a barrier such as a wall or partition 27 as shown in FIG. 5, on the perimeter of a room or space to be protected.

Control apparatus 14 is shown in FIG. 6 and comprises an alternating current generator 30 connected to tape 13 through a hybrid coupler 31. Generator 30 has an output preferably in the ultrasonic range, such as 30 KHz, which causes tape 13 to radiate acoustic field F into the area being protected. Tape 13 also receives intruder reflected signals at doppler-shifted frequencies which are transmitted through hybrid coupler 31 to a first receiver circuit 32 connected to an alarm device 33 and consisting of attenuator 34, mixer 35, bandpass filter amplifier 36 and processor 37. The above-described portion of apparatus 14 processes signals from tape 13 when operating in the active mode to activate alarm 33 and is described in greater detail in U.S. Pat. No. 4,023,155.

The portion of control apparatus 14 which processes signals generated by tape 13 operating in the passive mode is a second receiver circuit 40 comprising AC amplifier 41, integrator 42 and threshold circuit 43, the latter being connected to alarm device 33. A notch filter 44 is provided between amplifier 41 and the output of generator 30 to block the output of the latter from receiver circuit 40 in event the generator frequency and the bandpass of receiver 40 overlap (in some instances, it may be desirable to use a generator frequency lower than the ultrasonic range for the active mode, for example 2 KHz). A more detailed description of receiver circuit 40 is given in U.S. Pat. No. 3,763,482.

As mentioned above, tape 13 is a highly sensitive transducer at sonic frequencies including voice frequencies which enbables it use as a line microphone to enhance the effectiveness of the detection system. To achieve this additional advantage, an audio amplifier 46 is connected to the output of amplifier 41 and to the input of loudspeaker 47. This enables the operator to audibly monitor sounds picked up by tape 13 either directly through the air or indirectly through the fence. Such sounds including the human voice, the cutting of the fence by wire cutters, a person scalling the fence, motors of automobiles, aircraft, etc.. While a cable transducer has been used as a line microphone on a fence in the past by picking up audio signals transmitted to it through the fence as described in U.S. Pat. No. 3,833,897, the high sensitivity of tape 13 directly to acoustic waves at audio frequencies has substantially improved the effectiveness of this audible monitoring technique. Moreover, the relatively thin tape structure (overall thickness approximately 0.0015″), while making it sensitive to audio waves incident thereon from the air, also makes the tape desirably less sensitive to vibrations of the fence because the mass of the movable outer conductor 17 and cover 18 is sufficiently small to react readily to sound waves while reducing the excitation effect of fence vibrations.

In practice, we have found that the single tape form of the invention described above has an acceptable signal-to-noise ratio for a tape length of approximately 10 meters. For applications requiring larger tape lengths, the two-tape system 50 shown in FIG. 7 is employed. System 50 has a transmitter tape 51 connected by attenuator 52 to ultrasonic signal generator 53 and a separate receiver tape 54 connected to receivers 32 and 40, alarm 33 and loud speaker 47 as described above. Tapes 51 and 54 preferably and juxtaposed and coextensively mounted on the barrier adjacent to each other. Other than using two tapes for the transmitting and receiving functions, respectively, system 50 is essentially the same as the system described above with both tapes mounted side by side and parallel on inclined surface 21 of body 20.

What is claimed is:

1. A multimode intrusion detection system for use on a barrier forming at least part of the perimeter of an area to be protected, comprising:

transducer means comprising:

at least one elongated electret tape, said tape having an electret layer with two sides, a first conductive strip bonded tightly to one of the sides of said electret layer, and a second conductive strip disposed on the other side of said electret layer for limited movement toward and away from the electret layer whereby to produce and to receive sonic wave energy;

means for mechanically coupling said tape to said barrier with said first conductive strip proximate to and rigidly supported on said barrier and with said second conductive strip facing outwardly from said barrier;

an alternating current signal generator capable of producing an output at sonic frequencies and having said output electrically connected across said first and said second conductive strips of said tape;

first signal processor means connected to said tape conductive strips and being responsive to signals having doppler-shifted frequencies for producing an alarm; and second signal processor means connected to said tape conductive strips and being responsive to barrier-vibration-induced electric signals on said strips for producing an alarm.

2. A multimode intrusion detection system for use on a barrier forming at least part of the perimeter of an area to be protected, comprising:

first and second elongated electret tapes, each of said tapes having an electret layer with two sides, a first conductive strip bonded tightly to one of the sides of said electret layer, and a second conductive strip disposed on the other side of said electret layer for limited movement toward and away from the electret layer whereby to produce and to receive sonic wave energy;

means for coextensively mechanically coupling said tapes to said barrier with said first conductive strips proximate to and rigidly supported on said barrier and with said second conductive strips facing outwardly from said barrier;

an electric signal generator capable of producing an output at sonic frequencies and having said output electrically connected across said first and said second conductive strips of said first tape; and first and second signal processor means connected to said conductive strips of said second tape, said first processor means being responsive to signals having doppler shifted frequencies for producing an alarm, said second processor means being responsive to barrier-vibration-induced electric signals on said second tape strips for producing an alarm.

3. The system according to claim 2 with loudspeaker means electrically connected to said second tape conductive strips and being responsive to audio frequency signals thereon for producing corresponding sound waves.

4. The system according to claim 2 in which said barrier extends in a vertical plane, said transducer tapes being supported on said barrier with the plane of the tapes inclined relative to the plane of the barrier whereby the direction of propagation of sonic waves from said first tape is downward and outward from said barrier.

5. The system according to claim 4 with an elongated horizontally extending solid support body for said tapes, said body being capable of transmitting vibrations and being mechanically fastened to and in intimate contact with said barrier, said tapes being mounted on said body whereby vibrations in said barrier are transmitted through said body to said second tape.

6. The system according to claim 4 in which said body has a flat surface remote from said barrier and inclined downwardly and inwardly relative to the plane of said barrier, said tapes being mounted on said surface whereby the direction of the acoustic radiation pattern from the first tape is downwardly and outwardly from said barrier.

7. The system according to claim 6 in which said body has an acoustic insulator covering the top thereof whereby to insulate said body from the impact of rain.

8. The system according to claim 4 in which said barrier is a wire-mesh fence anchored in the ground, said tapes being mounted on said fence near its top and extending parallel to the ground.

* * * * *